United States Patent [19]

Figueres et al.

[11] 3,987,536

[45] Oct. 26, 1976

[54] METHOD OF AND APPARATUS FOR THE PRODUCTION OF BARS OR MACHINE WIRE

[75] Inventors: Roger Figueres, Voiron; Antoine Pitaval, La Tronche, both of France

[73] Assignees: Societe de Vente de l'Aluminium Pechiney; Cegedur Societe de Transformation de l'Aluminium Pechiney, both of Paris, France

[22] Filed: Apr. 15, 1975

[21] Appl. No.: 568,288

[30] Foreign Application Priority Data

Apr. 16, 1974 France ..... 74.13123

[52] U.S. Cl. ..... 29/526.6; 72/203; 29/527.7; 29/527.6; 29/557; 29/558; 164/87

[51] Int. Cl.[2] ..... B22D 11/126

[58] Field of Search..... 29/527.6, 527.7, 527.4, 29/557, 558, DIG. 32, DIG. 34, 526.6; 72/203

[56] References Cited

UNITED STATES PATENTS

| | | | |
|---|---|---|---|
| 1,120,831 | 12/1914 | Mathias | 72/203 |
| 1,476,593 | 12/1923 | Coffey | 29/557 X |
| 1,797,053 | 3/1931 | Detwiler | 72/203 |
| 2,394,381 | 2/1946 | Hoern | 29/558 |
| 2,699,904 | 1/1955 | Wood | 72/203 |
| 2,893,292 | 7/1959 | Naperola | 29/557 UX |
| 3,157,093 | 11/1964 | Shaw et al. | 29/557 X |
| 3,340,716 | 9/1967 | Funk | 29/527.7 |
| 3,561,105 | 2/1971 | Cofer | 29/527.7 |

*Primary Examiner*—C.W. Lanham
*Assistant Examiner*—V. K. Rising
*Attorney, Agent, or Firm*—Dennison, Dennison, Meserole & Pollack

[57] ABSTRACT

The method of and apparatus for the production of bars or machine wire from alloys of aluminum or copper by continuous casting of the rough shape in a grooved casting wheel closed by a band or chain and the subsequent steps of rolling and scalping the rough shape in a series of successive operations.

5 Claims, 2 Drawing Figures

METHOD OF AND APPARATUS FOR THE PRODUCTION OF BARS OR MACHINE WIRE

The present invention concerns the continuous casting and sequential rolling of wire or other shapes from alloys of copper or aluminum and more particularly concerns the process for improving the metallurgical quality of the product by elimination of defective zones therein.

Roughly shaped machine wires or bars cast on a grooved casting wheel closed by a cooled ribbon or chain and subsequently rolled do not pose a significant problem where pure metals such as aluminum or copper are employed. Alloys lightly charged, such as alloys Al-Mg-Si or type A-GS, or alloys Al-Mg of at least 2% magnesium may also be successfully employed.

However, when alloys such as aluminum-magnesium with more than 2% magnesium, the aluminum-copper magnesium alloys, the aluminum-zinc-magnesium alloys, are employed, defects such as shrink holes, inverse segregations, etc. form in the cast shape, particularly in the proximity of the contact surface with the ribbon or chain closing the groove in the casting wheel.

These defects are inherent to the casting process itself, particularly when conducted at speeds on the order of 10-15 meters per minute in a non-deformable circular mold. The defects occur because at the time of solidification, the casting cools and contracts adjacent the casting wheel and/or the ribbon or the chain. The cooling is especially noticeable on the side of the wheel when the casting alloy is copper because of the high degree of heat conductivity. Moreover, the curve of the wheel being imparted to the ribbon, the ribbon cannot deform sufficiently to remain in continuous contact with the rough casting. This is manifested most on the ribbon side of the casting by the generation of shrink holes often accompanied by an increase in the grain of the metal.

We have found that a slight scalping of the upper portion of the shape on the ribbon side considerably improves the quality of the product in the areas corresponding to this side, but this measure is not sufficient. In fact, while the scalping does remove the surface shrink holes, it also exposes the subsurface shrink holes.

Since the distribution of the shrink holes is relatively dense, especially in the proximity of the upper surface of the rough casting, this scalping improves the soundness of the wire at the outlet of the rolling mill in a general manner, but locally, cracks still appear together with traces of shrink holes which the scalping has exposed. It is then impossible to obtain a casting essentially free of defects even with additional scalping. In fact, under certain circumstances, the zone of porosities adjacent the ribbon moves upwardly to rejoin the zone of central porosities.

The applicants have discovered that if the scalping operation is performed after the first rolling step and with a sufficient degree of deformation at that step, the open shrink holes which ordinarily emerge are eliminated without the appearance of other subsurface shrink holes.

Another advantage of performing the scalping step after the first rolling step is that it is then possible to give the rough casting a convex form. Most of the open shrink holes are found to be concentrated in the center of the surface on the ribbon side of the casting and therefore the concentration is primarily in the convex portion of the once rolled product. Accordingly, it is precisely this portion and this portion alone which will be eliminated by the scalping operation. The convex form thus makes it possible to reduce to a minimum the portion of the shape eliminated by the scalping.

Scalping of the part of the rough shape in contact with the ribbon during the casting between the first and second rolling steps can be accomplished by any of the known mechanisms employed for this purpose.

Accordingly, it is an object of this invention to improve the quality of the product by eliminating the solidified portion thereof in contact with the ribbon or chain which has found to be rich in shrink holes and porosities and to do so under the application of continuous heat.

Referring now more specifically to the drawings.

Figure 1:
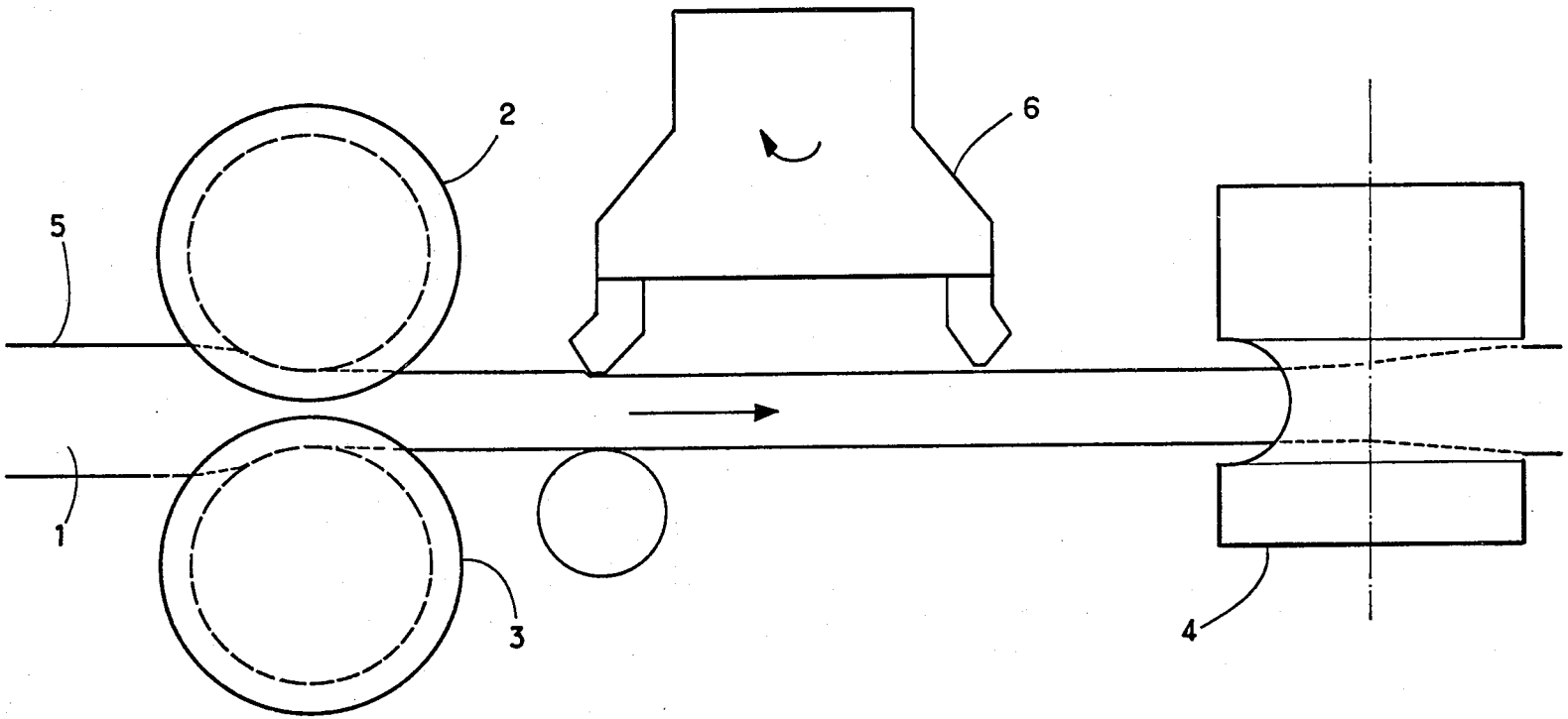
FIG. 1 is a side elevational view illustrating the invention in graphic form.
Figure 2:
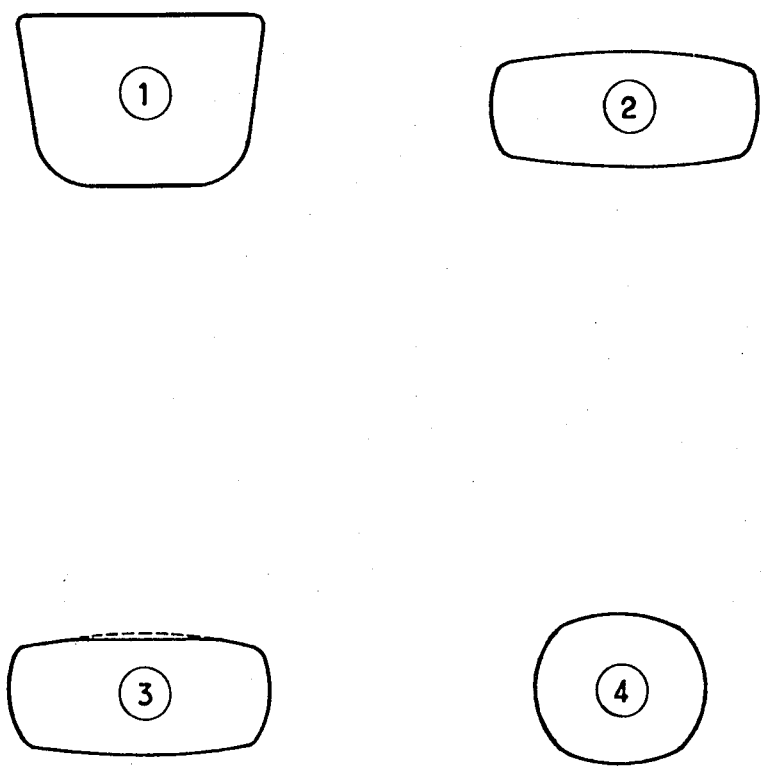
FIG. 2 is a cross-section of the shapes in sequential steps as they emerge from the several steps in the process.

In FIG. 1, the rough shape 1 is illustrated as it leaves the casting wheel (not shown) in the form generally illustrated in the upper left hand view of FIG. 2 and passes to a first rolling step where it is positioned between two rollers 2 and 3 to effect a first reduction of the shaping to the approximate configuration seen in the upper right hand view of FIG. 2. From the first rolling section, the rough casting passes into a second rolling section 4 (FIG. 1) where the roller axes are perpendicular to those illustrated in the first section. For purposes of orientation, the upper side of the rough casting nearest the groove closing ribbon or chain is identified as 5.

According to the invention, a cutting tool 6 is disposed between the first and second rolling steps. The cutter has an axis of rotation perpendicular to the surface of the rough casting. The cutting tool 6 thus engages the upper surface of the cast shape and removes a quantity of material therefrom sufficient to cause the shrink holes therein to disappear and to remove small cracks and surface segregations as well. A consideration of the lower left hand cross section in FIG. 2 provides an illustration of the areas removed by the scalping operation illustrated in the phantom line portion of the figure.

In operation, a rough shaping of aluminum alloys is cast in the mouth of the casting wheel and closed by the ribbon or chain closure member (not shown). The rough shaping 5 of the casting leaves the casting wheel (not shown) at a speed on the order of 10-12 meters per minute and passes through the first step or the rolling mill consisting of grooved rollers 2, 3. After emerging from the rollers 2, 3, the casting has the form illustrated in the upper right hand view of FIG. 2 and for purposes of an illustration may be assumed to have an approximate cross section of 725 $mm^2$ which corresponds to a reduction of approximately 19.5%, a reduction rate sufficient to minimize the shrink holes present in the proximity of the surface.

The upper surface of the rough shaping leaving the first rolling stage is slightly convex, as shown in FIG. 2 (also upper right hand view), and the defects are largely concentrated in the convex portion of this surface. The casting is then subjected to the scalping step accomplished by the scalping tool 6 to remove, in accordance with the nature of the alloy employed, a quantity of metal from approximately 0.5 mm to 1 mm in thickness and of a width of approximately 25–30 mm. The scalping tool employed in this example has a diameter of approximately 120 mm and rotates at a speed of approximately 2860 rpm employing 12 tools in the cutting head. Thus a cutting rate of approximately 1080 meters per minute is accomplished according to the speed of the casting wheel and the ratio or the reduction in the first rolling step together with the speed of the casting between two passes of the tool. The operation may be subjected to lubrication by application of a mixture of water and soluble oil with the rough casting maintained at a temperature of approximately 400° C. at the moment of scalping. Cuttings from the scalping operation are gathered by a collector positioned in proximity to the cutting device. The percentage of cut material removed is on the order of 2–2.5% by this method, whereas in order to eliminate the defective zone completely by directly scalping the rough shaping, as it appears in the upper left hand view of FIG. 2, would require a loss on the order of 3½-4%.

After the scalping operation, the rough casting assumes the form represented by the full line illustration in the lower left hand view of FIG. 2 and thence is passed to the second rolling step represented by 4 in FIG. 1. After the second rolling step, the casting assumes a form generally illustrated by the lower right hand view of FIG. 2.

Following the steps outlined above, we have produced a product in which no shrink holes, cavities or cracks appear after the second rolling step or any subsequent rolling step which may be employed.

We claim:

1. The method of making continuously cast elongate metallic products comprising the steps of fabricating by continuously casting an elongate metallic article in a grooved casting wheel wherein surface imperfections tend to be concentrated in a localized area adjacent a surface along the length of said article, passing said article through a first rolling step to elevate said localized area and form at least a portion of said area into a convex surface, scalping at least a portion of said convex surface formed in said first rolling step and subjecting said rolled and scalped product to at least one additional rolling step.

2. The method of claim 1 wherein said scalping step is accomplished by a rotating cutting wheel.

3. The method of claim 1 wherein said product is fabricated from an alloy of aluminum.

4. The method of claim 1 wherein said product is fabricated from an alloy of copper.

5. The method of claim 1 wherein said product is fabricated from an alloy of magnesium.

* * * * *